US006234412B1

(12) United States Patent
von Schuckmann

(10) Patent No.: US 6,234,412 B1
(45) Date of Patent: May 22, 2001

(54) SPRAY PUMP CAPABLE OF BEING ACTUATED BY A HAND LEVER

(76) Inventor: Alfred von Schuckmann, Winnekendonker Strasse 52, D-47627 Kevelaer (DE)

( * ) Notice: Subject to any disclaimer, the term of this patent is extended or adjusted under 35 U.S.C. 154(b) by 0 days.

(21) Appl. No.: 09/486,887

(22) PCT Filed: Sep. 2, 1998

(86) PCT No.: PCT/EP98/05554

§ 371 Date: Mar. 2, 2000

§ 102(e) Date: Mar. 2, 2000

(87) PCT Pub. No.: WO99/11386

PCT Pub. Date: Mar. 11, 1999

(30) Foreign Application Priority Data

Sep. 4, 1997 (DE) ..... 197 38 777
Jun. 18, 1998 (DE) ..... 198 27 111

(51) Int. Cl.[7] ..... A62C 11/00

(52) U.S. Cl. ..... 239/333; 239/493; 239/491; 222/321.8; 222/383.1

(58) Field of Search ..... 239/333, 493, 239/491, 331, 329, 463; 222/321.8, 383.1, 381

(56) References Cited

U.S. PATENT DOCUMENTS 3,701,478 10/1972 Tada .
3,726,442 4/1973 Davidson .
3,897,006 7/1975 Tada .
3,913,841 * 10/1975 Tada ..... 239/321
4,072,252 2/1978 Steyns et al. .
4,273,268 6/1981 Wickenberg .
4,558,821 12/1985 Tada .
4,643,338 * 2/1987 Iizuka ..... 239/333
4,646,969 3/1987 Sorm et al. .
4,826,052 5/1989 Micallef .
4,955,511 9/1990 Blake .
5,603,434 2/1997 von Schuckmann .
5,810,209 9/1998 Foster .
5,996,847 * 12/1999 Smolen, Jr. et al. ..... 222/383.1

FOREIGN PATENT DOCUMENTS 0360949 of 1990 (EP) .
2495022 of 1982 (FR) .

* cited by examiner

*Primary Examiner*—David A. Scherbel
*Assistant Examiner*—Dinh Q. Nguyen

(57) ABSTRACT

The invention concerns a spray pump (3) capable of being actuated by a hand lever, to be mounted on dispensers (2) or the like. Said pump comprises a piston pump (6) capable of sliding linearly in a pump chamber (7) on the housing side. Said piston is connected, on the rear side of an outlet (9), to the hand lever (5) and returns to its base position urged by a spring. The invention aims at producing a pump which is both simple and reliable by associating two articulating parts (I, II) with the lever (5). One (I) of said parts is located so as to slide in a linear slider on the housing side, and the other (II) is fixed to the housing, on the side opposite the outlet (9), such that the two articulating parts (I, II) are connected by mutually collapsible contiguous parts (a, b).

42 Claims, 5 Drawing Sheets

Figure 3:
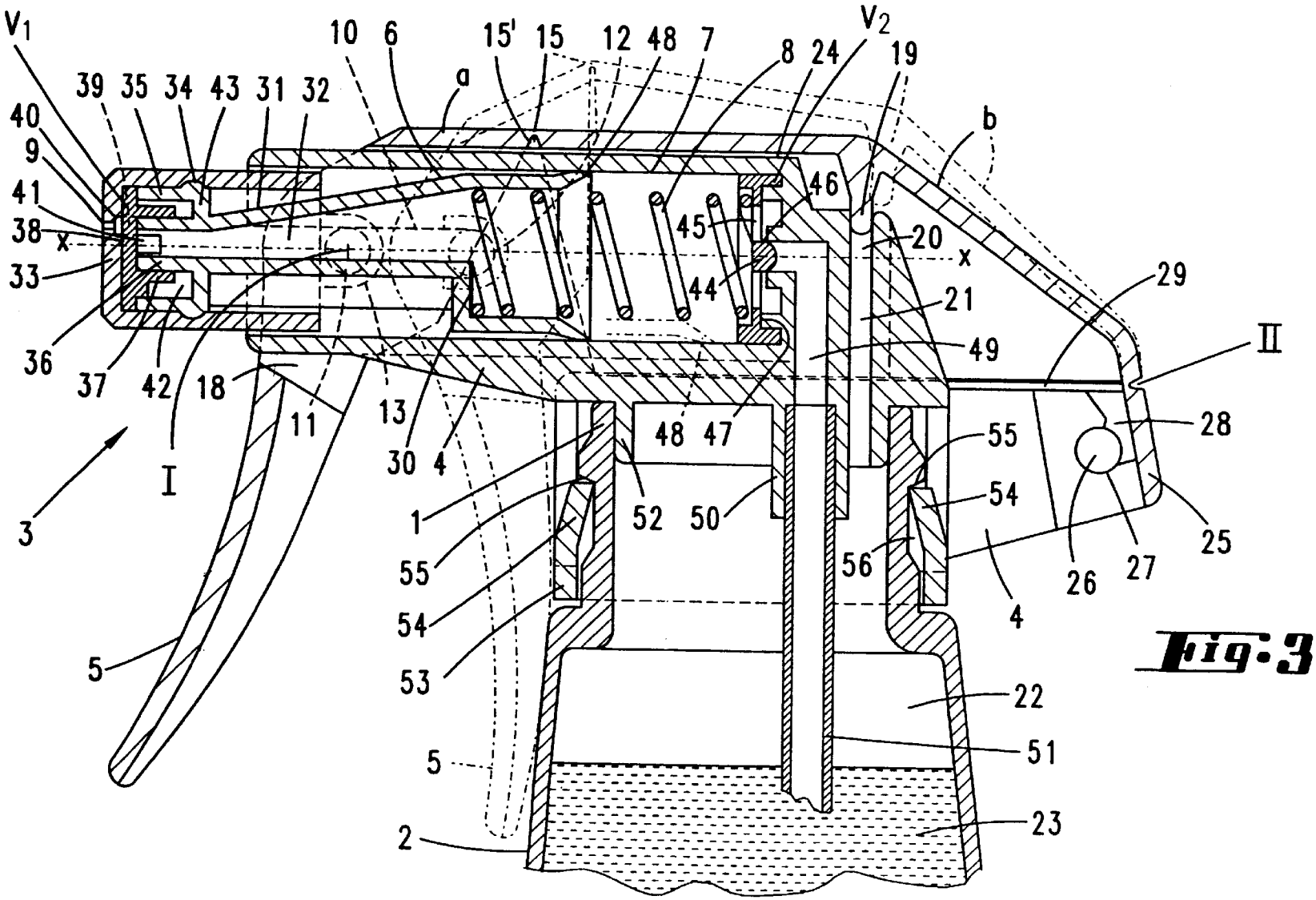

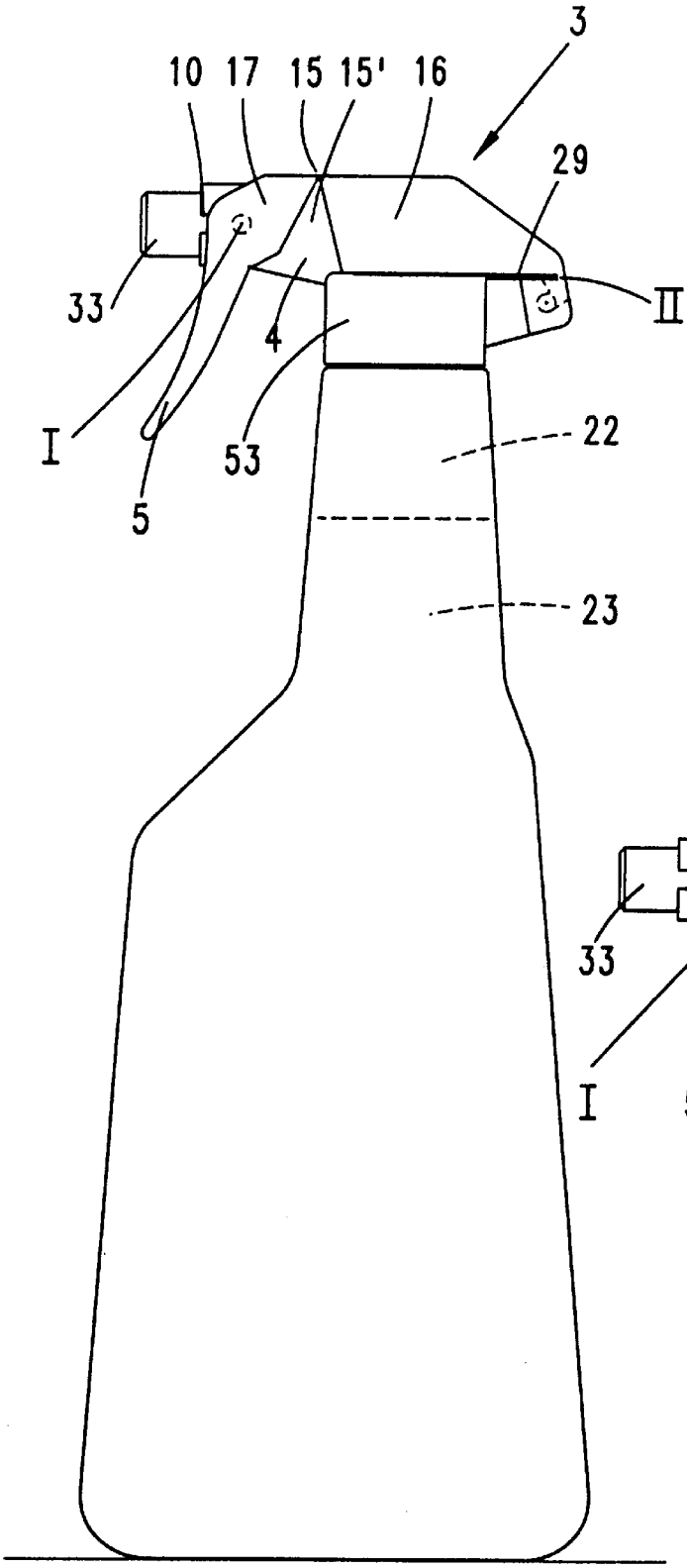
Fig. 1
Fig. 2
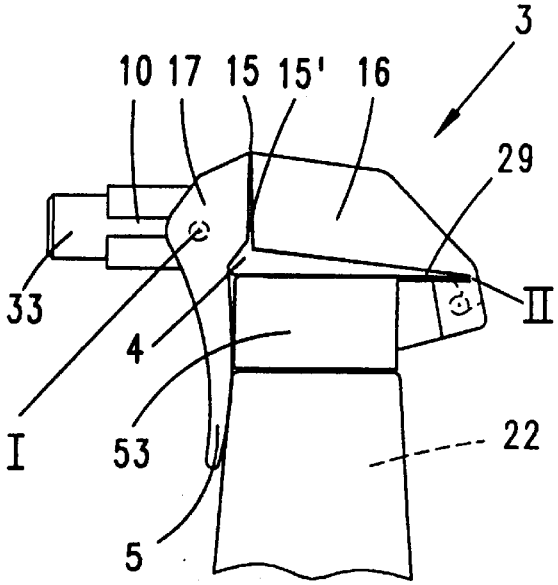

V1
V2
I
II
x
a
b

SPRAY PUMP CAPABLE OF BEING ACTUATED BY A HAND LEVER

SUMMARY

The invention relates to a hand lever-operated spray pump (3), particularly for attaching to bottles (2) or similar, having a pump plunger (6) which moves linear in a pump chamber (7) on the housing and which is connected with the hand lever (5) at the rear of a mouth piece opening (9) and which returns to its starting position as a result of a spring loading, and proposes, for the purpose of achieving a structurally simple, functionally reliable solution, to allocate two hinge points (I, II) to the hand lever (5) one of which (I) is movable in a linear guide on the housing side and the other (II) is arranged on the housing on the side opposite to the mouth piece (9) in such a way that both hinge points (I, II) are connected by means of two buckling bridge sections (a, b).

The invention relates to a hand lever-operated spray pump, particularly for the purpose of attaching to bottles or similar, having a pump plunger that moves linear in a pump chamber of the housing. The pump plunger is connected with the hand lever at the rear of a mouth piece opening and the pump plunger returns to the starting position as a result of a spring loading.

A spray pump of this type is specified in U.S. Pat. No. 4,955,511, where the hand lever is a trigger lever which is rigidly connected with the pump plunger. This causes a tendency for the pump plunger-pump chamber unit to tilt.

U.S. Pat. No. 3,726,442 specifies a hand lever-operated spray pump whose hand lever is arranged on a pivoting bearing by means of a fork recess/peg engagement on the housing. Separated by a space thereto, it acts via a living hinge in conjunction with a transmitting part provided on the upper pump side and acting upon the pump chamber, which is of a bellows-type in this case. The transmitting part is connected to the housing on the side opposite to the mouth piece by means of an additional living hinge. A finger on the transmitting piece closes/opens a venting opening.

It is the object of the invention to provide a hand lever-operated spray pump of the above type which is functionally reliable and structurally simple.

This problem is solved substantially with a hand lever-operated spray pump having the characteristics of claim 1. The hand lever is provided with two joints one of which is moving in a linear guide provided on the housing, and the other is attached to the housing on the side opposite to the mouth piece in such a way that both joints are connected via two bridge sections that buckle with respect to each other. This construction prevents the pump plunger from tilting. The hand lever performs a superposing movement: pivoting plus shifting. The respective linear guide is defined by the guide on the housing. There is approaching between both joints which is compensated simply in that the bridge sections buckle or fold. This movement can even produce a force for restoring the pump plunger to its starting position when the hand lever is connected to such bridge sections. The bridge sections' buckling movement may further be utilized for an additional function in that one bridge section supports a closure part for a ventilation aperture which leaves its sealing position with respect to the ventilation aperture during the buckling process. This solves the problem of air ventilation by the easiest possible method. As the buckling process takes place only when the pump is activated, this provides for a space-saving outline in non-operating position, offering both storage and packaging advantages. According to the subject matter of U.S. Pat. No. 3,726,442, the overall size of the spray pump decreases only when it is activated. In addition, the invention proposes to provide a living hinge between the two bridge sections, thereby eliminating the need for classic axes. The second bridge section is then further developed such that it represents the web of a U-profiled part that encompasses the housing in a U-shape. This provides a strong fixing construction for the bridge.

In addition, the design is characterized by a locking connection from the U-profiled part toward the housing. Whereas this locking connection can be used to achieving the required flexibility for the respective bridge section, the joint which is located on the side of the spray pump opposite to the mouth piece, is a living hinge adjacent to the place of the locking connection. This also prevents any movements caused by the bridge sections' movement to be transferred to said place. In addition, a further development, which has its own significance, consists in that the pump plunger extends with a continues tapering member approximately up to the mouth piece where it is in form-fit connection with a mouth piece cap and that, between the two parts, a discharge valve is provided in the form of a deformable rubber part. This represents a structural simplification, allows easy assembly and requires fewer parts. The rubber part is of the type which remains closed until a certain high pressure response threshold is reached at which time it opens abruptly. This results in a powerful spray jet, especially if the rubber piece is mounted on the front end of the pump plunger and is equipped with a collar which expands as a result of the pressure caused by the fluid, and if it has axial flow-through cross sections in a disk-shaped part. These cross sections are connected with the mouth piece opening in that the mouth piece cap is rotated. This rotation is eccentric in order to close off the spray pump with respect to content losses as well. It is advantageous if the spray pump housing is attached to the bottleneck by means of a plug-in/clip connection substituting the normally used swivel or coupling nut. With the attachment of a collar, the plug-in connection is able to simultaneously function as a sealing connection.

In addition, the spray pump as per the invention is characterized by a disk-shaped inlet valve having a valve shutting member which is supported by webs. The pump plunger restoring spring is supported by said webs. The opposite end of the spring moves against a cross section-decreasing shoulder in the interior of the hollow pump plunger which trails on the wall of the pump chamber with the edge of the larger cross section opening. This edge is preferably a sleeve-like lip. It is also advantageous to equip the pump plunger with lateral pockets for the joint on the hand lever. The hand lever has trunnions which pass through the linear guide engage in the bearing pockets. An advantageous variant of an air ventilating system is the utilization of the pump plunger. According to this variant, the housing wall of the pump chamber is provided with a ventilation aperture extending into the interior of the bottle. When the pump is in its starting position, the aperture, which is located directly behind the edge of the pump plunger, is closed by the pump plunger, and opens when the pump plunger is activated. This provides for an additional pump plunger function. It acts as a valve slide. This does not even require that the plunger casing wall is continuously leading. It suffices to equip the pump plunger with two piston rings which, in the pump plunger starting position, are located on either side of the ventilation aperture. This decreases the friction against the pump plunger and favors the desired easy activation of the trigger pump. There is an added advantage in that, as a result of creating the ring space, the piston ring, positioned in the direction of discharge, acts as a seal with relation to the pump chamber, for example in the event of excess pressure in the bottle which may be generated by heat.

An advantageous further development should be noted with respect to the inlet valve. This development is achieved by a disk-shaped inlet valve body which is symmetrical with relation to the disk center plane. The respective mirror symmetrical form permits the use of either side of the inlet valve body, thereby preventing any assembly mistakes or rework requiring that a side inverted inlet valve be reversed. Regardless of its allocation, the desired valve function is always reliable. It is also advantageous for the valve shutting member of the inlet valve to be barrel-shaped having hemispherical ends on both sides. The valve member is located in the center of the disk-shaped inlet valve body.

Furthermore, the discharge valve is also further developed in that the discharge valve is covered by the mouth piece cap and in that supply channels leading toward the mouth piece opening are provided on the front side of the outlet valve. The supply channels can be closed by rotating the mouth piece cap. This is achieved in that the discharge valve is a deformable rubber piece which is equipped with a stem. One end of the stem supports a valve disk while the other end is equipped with a cylindrical stopper part having diametrically opposed flattened parts that create channels. Supply channels lead from the front of the flattened parts to a central swirl chamber. Due to its larger mass of material the stopper part is virtually not deformable so that the channel cross sections remain largely unaffected despite the pressure caused by the content, while the valve disk provides the flexibility and restoring force required for the valve function.

For the purpose of shutting it is advantageous for the swirl chamber to be eccentrical, resulting in a congruent position with the mouth piece opening, which is also eccentrical, and the ability to leave this position which results in blocking the discharge path.

Finally, with respect to the joint of the second bridge section, it is proposed to use a hook for the locking connection on the housing and a supporting web for the pivot function by engagement of the front surface thereof on a housing console at the rear end of the pump. It is structurally advantageous for the hook to pass through a hole in the rear housing console, and that the supporting web located behind the hole and creates the hinge and runs substantially parallel with the shaft of the hook so as to form the end of the second buckling bridge section. The close proximity between the supporting web and the hook provides for sufficient play to allow the bridge sections to buckle. Added to that is the flexibility and restoring force of the material used, i.e. synthetic material.

Figure 4:
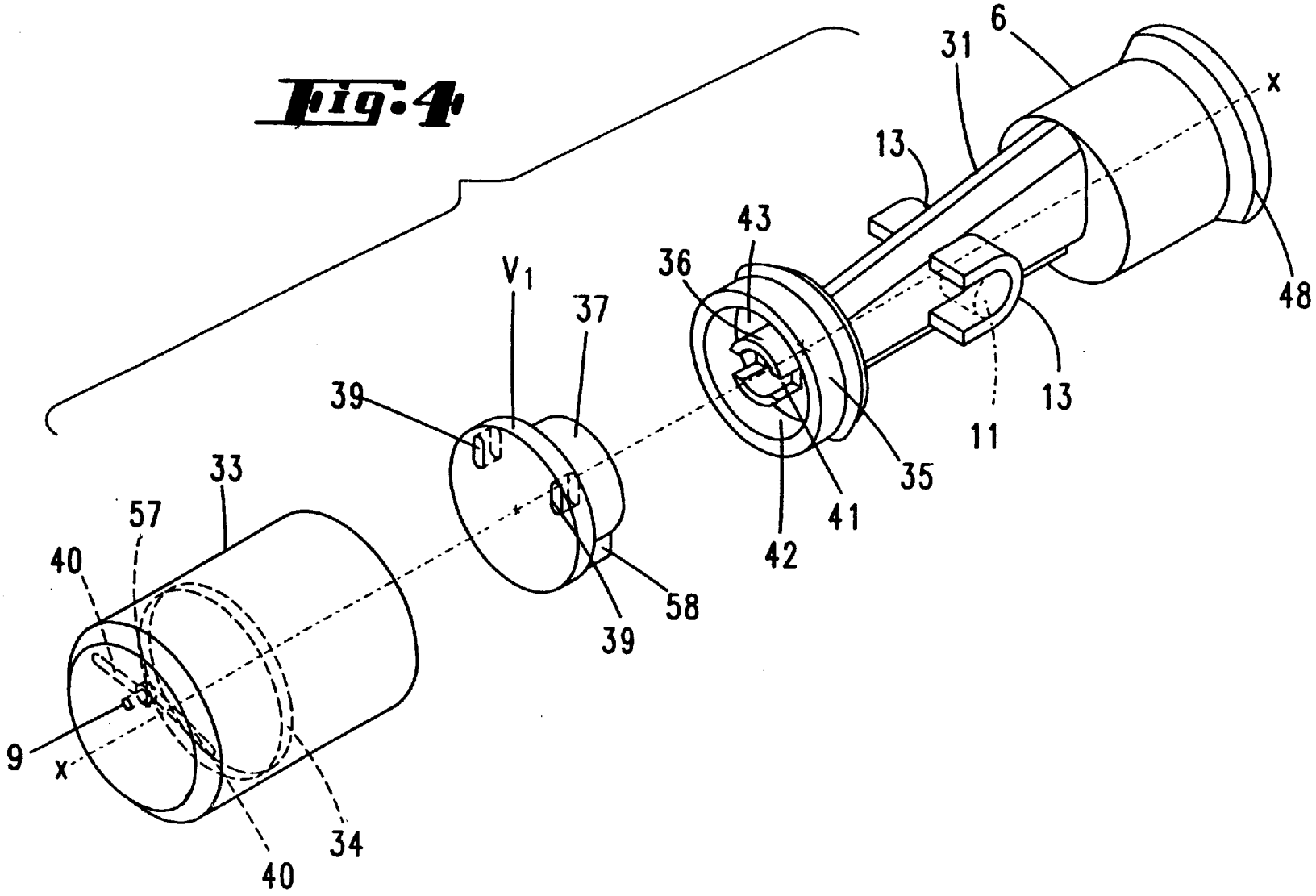
Figure 5:
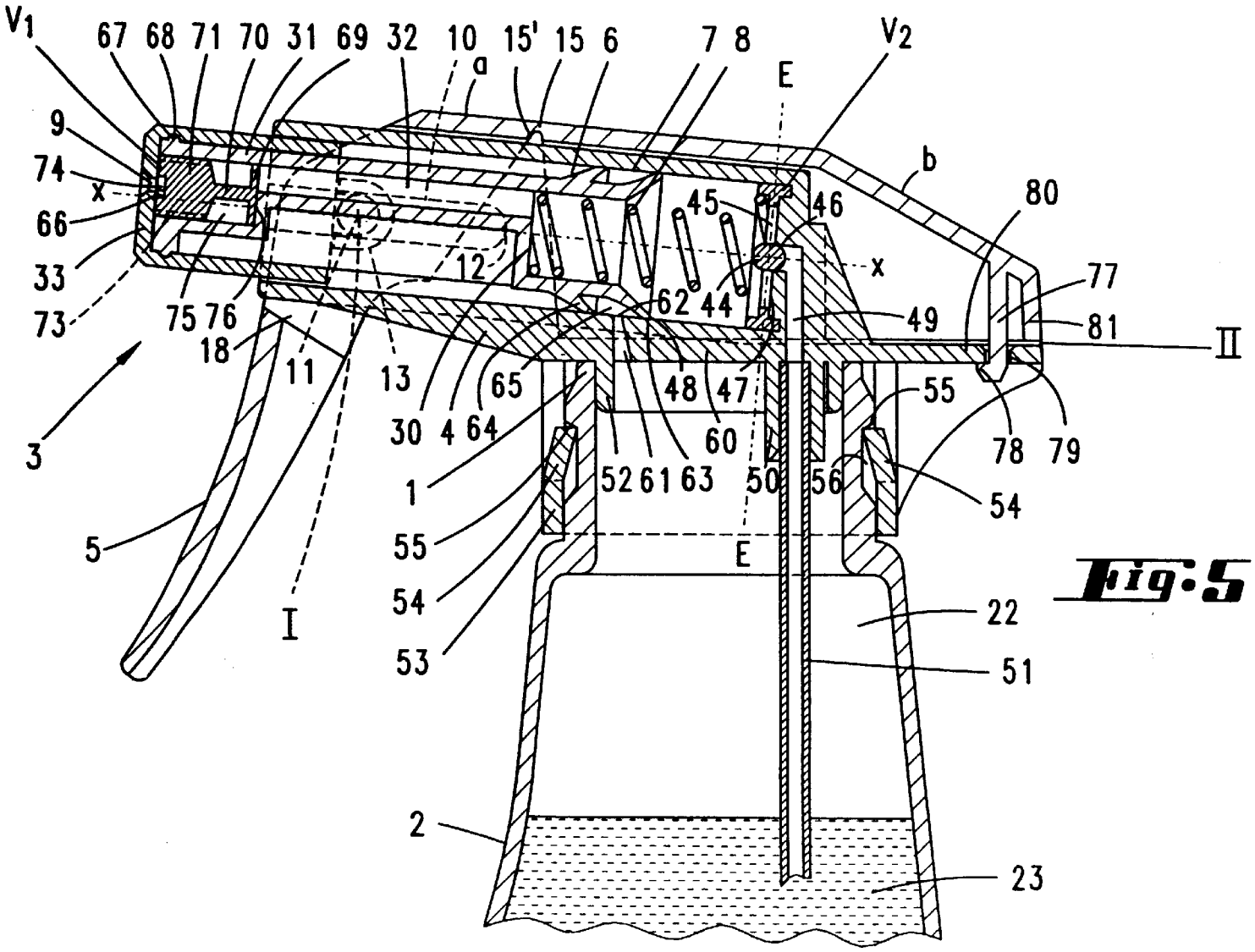
Figures 6, 7, 8:
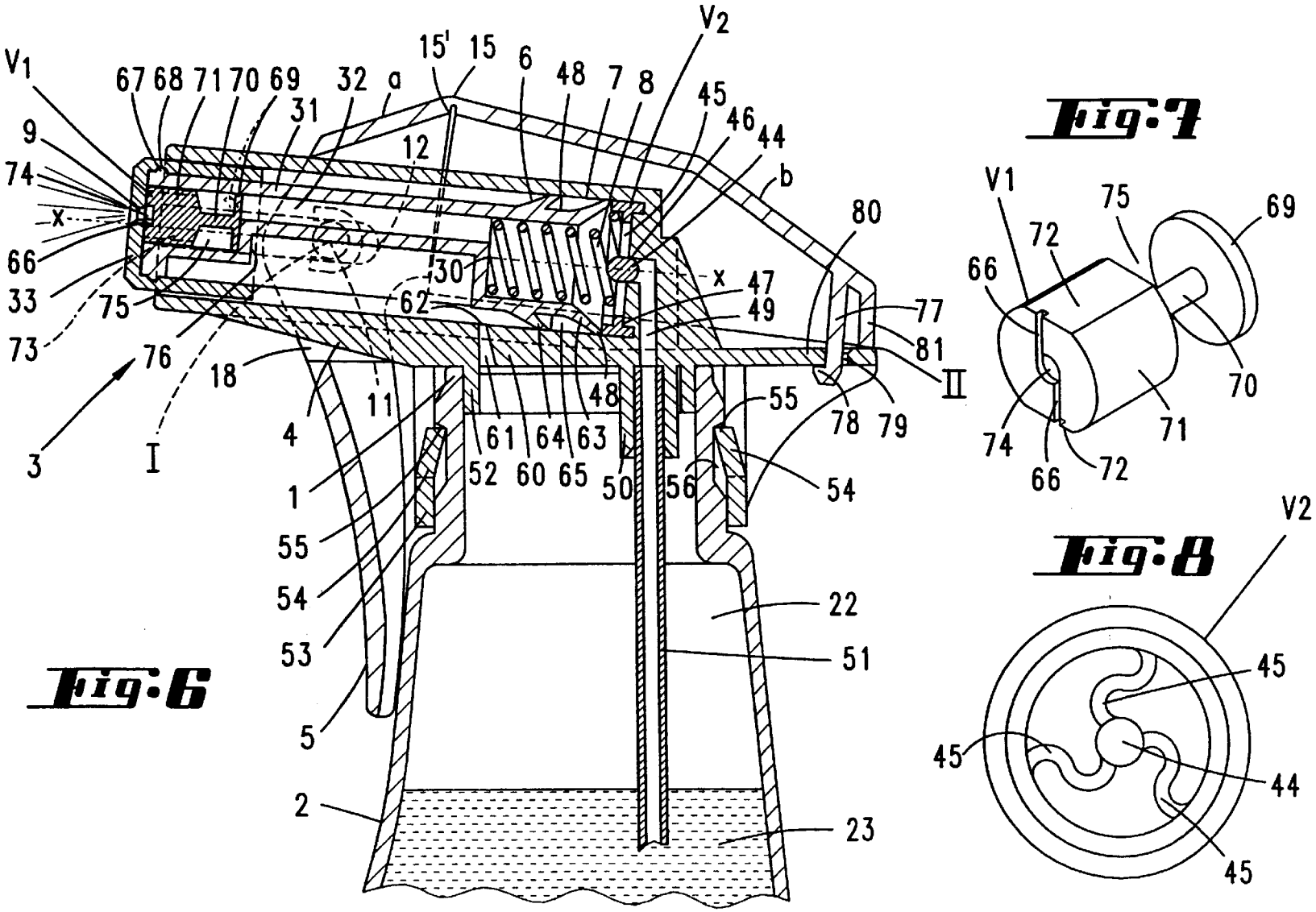

The invention is described below in more detail by means of an exemplary embodiment illustrated in the drawings wherein:

FIG. 1 show the spray pump of the invention on a bottle, in starting position;

FIG. 2 the same spray pump in operation;

FIG. 3 a longitudinal section through the pump in starting position with dash-dot lines suggesting the operating position;

FIG. 4 the pump plunger shown individually, in perspective, including the discharge valve and the mouth piece cap in exploded view;

FIG. 5 a vertical sectional view of a modification of the spray pump in starting position;

FIG. 6 the same spray pump in operating position;

FIG. 7 an enlarged perspective view of a modified discharge valve with respect to FIG. 6, and FIG. 8 an enlarged plan view of an inlet valve with respect to FIG. 6.

A spray pump 3 is allocated to the offset neck 1 of a bottle 2. It is a so-called trigger pump, representing a standing unit in the form of a dispenser for dispensing a powerful spray jet.

The core of the spray pump 3 is a housing 4, which extends in the manner of a hammer head transverse to the neck 1 which is substantially vertical. The neck 1 can be grasped to provide counter-support for the hand. A hand lever 5, projecting toward the underside of the housing 4, is located in the range of action of the hand which holds the device.

The hand lever 5 is swingable or pivotable about a horizontal first joint I of the activation mechanism when pulled against the neck 1. This takes place against a spring loading which, upon release, always returns the hand lever 5 to the starting position as shown in FIG. 3.

The activation position is shown in FIG. 3 with dash-dot lines.

The hand lever 5 is coupled to a pump plunger or piston 6 which moves in a pump cylinder 7 and forms a pump chamber therewith.

The connection between the hand lever 5 and the pump plunger 6 is such that the hand lever 5, in addition to the above mentioned pivotion moves linear in the pump chamber direction together with the pump plunger 6. The respective displacement acts against the expansive power of a pump plunger restoring spring 8 which is located in the pump chamber. This spring is a helical pressure spring.

The superposing movement made by the hand lever 5 is realized via a linear guide on the housing. The tube-shaped housing wall has longitudinal slots 10 that extend from the housing end adjacent to the mouth piece opening 9 of the spray pump 3. The longitudinal slots 10 are open toward the front edge of the tube and extend on diameter in longitudinal direction so as to define the operating stroke of the pump. A pair of trunnions on the hand lever 5 is for providing the joint I and rides on the slot walls until reaching the slot end 12.

The trunnions 11 traverse the pair of longitudinal slots 10 and have ends which engage in respective pockets 13 provided on both longitudinal sides of the pump plunger 6. Driving the pump plunger 6 in the sense that the volume of the pump chamber 7 decreases, is made by moving the trunnions 11 along the slots 10.

The hand lever 5 is connected with the housing 4 by means of a link chain. In actuality, this is achieved in that two hinge points are allocated to the hand lever 5, the above mentioned joint I and a second joint, designated with II, which is located on the side of the pump housing 4 opposite to the mouth piece opening 9.

The pair of joints I, II are connected by means of two bridge sections a, b that buckle with relation to each other. The buckling position is seen in FIGS. 2 and 3. In order to permit the bridge sections a, b to buckle respectively opposite to the housing 4, they are connected via a hinge joint 15 which may be a living hinge. The respective V-notch 15' continues into the cheek-like side walls 16 of the cap-like bridge section b and also into the shield-like root section 17 of the hand lever 5. The coaxially oriented trunnions 11 are attached to the insides of the root section 17.

Consequently, the bridge section b which changes to the substantially vertical side walls 16 is U-shaped.

The root section 17, which is attached to the bridge section a and represents a part thereof, has a closed wall extending toward the grip section of the hand lever 5 with a hole 18 in it allowing the tube-shaped end of the housing 4 to pass freely. Hole 18 is a plug-in hole for the purpose of assembly.

The bridge section designated with b supports a closure part 19 which 20 in the pump starting position tightly seals a ventilation aperture registered thereto.

The ventilation aperture 20 joins a connecting channel 21 which passes through the housing 4 in vertical direction and which is connected with the interior 22 of the bottle 2. When the bridge sections a, b, buckle, as shown in FIG. 2, the closure part 19 on the bridge section b lifts off from the ventilation aperture 20. The partial amount of the fluid substance 23 discharged from the bottle 2 in this position is thus supplemented with air.

As shown in FIG. 3, the bridge sections a, b connected through hinges are resting snugly on the level, horizontal upper side 24 of the housing 4 when the spray pump 3 is in starting position. When the discharge is activated, the bridge sections a, b peaking out in roof fashion from the upper side 24, preceded by the living hinge point which was created in the area of the hinge joint 15, however, without giving up the lateral support from the lateral walls 16 of the bridge section b provided by the guide support on the vertical walls of the pump housing 4, or the respective support from the two root sections 17.

The free end of the second bridge section b opposite to the mouth piece opening 9 is provided with a downward directed U-profiled part 25. It also represents an extension of the U-shaped cross section design of the second bridge section b, so that the second bridge section b represents the connector of the U-profiled part which encompasses the housing 4 in a U-shape. One locking peg 26 each is provided on the insides of the U-sections of the U-profiled part 25. The peg 26 engages in a counter locking contour 27. The respective locking connection between the U-profiled part 25 toward the housing 4 is illustrated particularly clearly in FIG. 3. The counter locking contour 27 is provided with an opening 28 which faces away from the mouth piece opening 9. The opening's 28 inside diameter is somewhat smaller than the cross section of the circular peg 26.

At the level of the second joint II the U-profiled part of the link chain has a horizontally and longitudinally extending slit 29 which traverses the U-sections for reaching the living hinge 15 and the rear side of the lever 5. The longitudinal slit 29 provides a peripheral material bridge at 15 and II.

The second joint II represents a living hinge. The V-notch slopes outward and is clearly diverging. The hinge point II, which is located on the side of the housing 4 opposite to the mouth piece opening 9, is slightly above the place of the locking connection 26/27.

Beginning at the actual cylindrical plunger section of the pump plunger 6 the latter continues tapering from an eccentric shoulder 30 approximately to the mouth piece opening 9. This is a type of plunger shaft 31 which adds a connecting channel 32 between the pump chamber 7 and the mouth piece opening 9. On the side of the mouth piece, the pump plunger 6 is connected with a mouth piece cap 33. It is a form-fit connection. The cap 33 is clipped on irreversibly, which is achieved by means of a pot-shaped ring collar 35 attached to the casing of the plunger shaft 31. The ring collar's 35 pot-shaped wall defines the tube-shaped front end 36 of the hollow plunger shaft 31 or of the pump plunger 6, respectively.

A discharge valve V1 in the form of a deformable rubber piece is housed in a space between the front end 36 and the attached mouth piece cap 33.

The rubber piece has a collar 37 which is plugged onto the tube-shaped front end 36 of the pump plunger 6. In addition, the rubber piece is provided with an integrally attached disk-shaped base part 38 containing axially oriented flow-through cross sections 39. These are connected with supply lines 40 leading to the mouth piece opening 9 in that the mouth piece cap 33 rotable on the ring collar 35 of the pump plunger 6 is rotated. The respective open and close positions are defined by stops. The edge of the mouth piece cap 33 keeps the pockets 13 on the side of the mouth piece opening closed.

The flow-through cross sections 39 and the supply lines 40 are eccentrical with respect to a horizontal rotational axis x-x of the pot-shaped mouth piece cap 33. The axis is identical to the longitudinal center axis of the pump plunger 6.

The closure valve V1 functions as it were a tube valve in that the collar 37 expands with the fluid pressure.

The windows 41 in the wall of the tube-shaped front end 36 provide access for the fluid in order to expand the collar 37. The medium rushes into a ring chamber 42 provided between the casing of said tube-shaped front end 36 and the interior wall of the ring collar 35. The ring chamber 42 is closed on the plunger side by means of a transverse wall 43 on the plunger shaft 31.

Closer to the interior 22 of the bottle 2 is the inlet valve V2 which also consists of an elastic material and which is disk-shaped. It is equipped with a centrally located valve closing member 44 which is supported by webs 45 that leave a flow path between them.

The webs 45 extend substantially radially. They preferably curve in the shape of an S to achieve the opening and closing flexibility for the valve closing member 44. The valve closing member's 44 valve seat on the housing side is designated with 46.

The inlet valve V2 is seated on the bottom 47 of the pump chamber 7 opposite to the mouth piece opening 9 and is held in position by the pump plunger restoring spring 8 in that the winding at its end pushes the disk-shaped body of the inlet valve V2 against the bottom 47.

The opposite end of the pump plunger restoring spring 8 acts as a load against the cross section-reducing shoulder 30 in the interior of the hollow pump plunger 6.

As shown in FIG. 3, the end of the pump plunger 6 opposite to the shoulder 30 is rotation symmetrically formed into a ring lip. It forms an edge 48 while the cross section of the remaining cylinder wall of the pump plunger 6 recedes. The edge's 48 larger cross section opening trails on the wall of the pump chamber 7.

Following a short horizontal channel section, the valve seat 46 changes to a vertical channel section 49 which continues in a connection piece 50 where an ascending pipe 51 is clamped on. The ascending pipe 51 nearly reaches the bottom of the bottle 2.

For a tight fit between the spray pump 3 and the bottle, the housing 4 forms a ring wall 52 at its underside.

The ring wall 52 is pushed into the opening at the neck 1 to provide a tight seal.

In order to attach the spray pump 3 the housing 4 is plugged onto the neck 1 of the bottle 2 by means of a plug-in/clip connection. This is achieved with a plug-in collar 53 which is equipped with locking fingers 54 located on diametrically opposed sides. By means of an irreversible snap connection, the locking fingers 54 engage in a blocking flank 55 on the neck 1. This is provided at the underside of a collar-like projection and is overrun in forward motion by the locking fingers 54 acting like barbs.

The blocking flank 55 represents the upper end of a rest trough 56 on the casing of the neck 1. The width of this trough 56 in circumferential direction of the neck 1 corresponds to the width of the locking fingers 54 which also achieves an advantageous rotation lock. This results in a defined orientation for the hammer head-like spray pump 3 with respect to the bottle body which may be designed flat in the same direction.

With respect to the supply lines 40, it should be noted that they end tangentially in a collecting chamber which creates a swirl chamber 57. This causes a rotation effect and thus generates a stable jet.

The discharge valve V1 is mounted non-rotating in the ring chamber by means of an eccentric projection 58 which projects into a matching recess (not shown) in the ring collar 35.

The modification of the spray pump 3 illustrated in FIGS. 5 through 8 is designed according to the same principle. The reference Nos. are used accordingly. Any extensive applicable specifications are not repeated.

The modified air venting system is discussed first. With respect to activation, it has been shifted to the range of action of the pump plunger 6. The latter represents a productive functional part of this system. The pump plunger 6 acts as a slide valve.

In actuality, this is embodied in that the housing wall 60 is equipped with a ventilation aperture 61 on a plane of projection on the bottle neck 1. The aperture 61 provides the shortest possible flow connection between the pump chamber 7 and the interior 22 of the bottle 2. The ventilation aperture 61 extends on the underside of the housing 4 as defined by the ring wall 52. The latter is pushed into the opening on the bottle neck 1 to seal.

In pump starting position (also see FIG. 5), the ventilation aperture, or mouth 62 extending through the lower wall of the pump chamber is closed by the peripheral wall of the pump plunger 7. As shown, said mouth 62 extends adjacent to the edge 48 of the pump plunger 7 which edge acts as a piston ring 63.

A second piston ring, designated with 64, is provided axially spaced apart and offset in the direction of the mouth piece opening 9 of the spray pump 3. Both piston rings 63, 64 are pointed in the form of a lip in the direction of their free ends. With respect to the discharge direction, the piston rings 63, 64 are receding and have a pitch of approx. 30° with reference to the axis x-x.

In the pump starting position (FIG. 15) the mouth 62 is arranged approximately centrally in a ring space 65 between the two piston rings 63, 64 which are axially spaced apart. Any excess pressure, which may be caused by heat, is transferred to the ring chamber 65. This causes the second piston ring 64 on the ring space side to be pressed even more tightly against the cylinder wall of the pump chamber 7, thereby increasing the sealing effect. If the bottle should tip, no fluid is able to flow out.

In pump plunger operating position (also see FIG. 6) the interior 22 is connected with the atmosphere via the ventilation aperture 61. The discharge side, i.e. behind the piston, a path is open through outlet channel 32 to the mouth piece cap 33 and opening 9. The discharged liquid substance 23 is compensated by the inflowing air.

When the hand lever 5 is released, the pump plunger 6 returns to its starting position, illustrated in FIG. 5, as a result of the spring loading.

In the modification to the spray pump 3 the inlet valve V2 is designed in such a way that, regardless of which of its surfaces meets the bottom 47 of the pump chamber 7, it is always properly placed. This is due to the mirror symmetrical design. Again, it is based on a disk-shaped inlet valve body made of a readjustable material with a centrally located valve closing member 44. However, the centrally located closing member 44, which again is attached to webs 45, is now designed end identical, i.e. a barrel-shaped locking piece is equipped axially on both sides or both ends, respectively, with convex hemispherical ends. The end on the allocation side acts together with the valve seat 46 on the bottom 47. The center axis of the barrel-shaped closing member 44 coincides with the rotational axis x-x of the pot-shaped mouth piece cap 33. In addition, this axis is identical to the longitudinal center axis of the pump plunger 6.

A peripheral collar also projects rotation symmetrically on both sides of the inlet valve body, forming or delimiting, on one side, a spring hanger together with a crosspiece for the winding on the end of the pump plunger restoring spring 8, and, on the other side, together with its other crosspiece, it is seated in a ring groove with corresponding contour in the bottom 47. As illustrated in FIG. 8, the crosspieces 45 are S-shaped on said plane, thereby providing sufficient spring reserves for the valve function. The crosspiece ring has a virtual T-section with the T-connector being centrally aligned with the valve closing member 44. In FIG. 5, the disk center plane is designated with E—E.

With respect to further developing the discharge valve V1, the pot-shaped design has been modified to a solid body. Reference is made to FIGS. 5 and 7.

Again, the discharge valve V1 is allocated to the mouth piece cap 33 in such a way that the supply channels 66, located on the fore-part of the discharge valve V1, can be closed with relation to the decentrally located mouth piece opening 9. The rotation guide is an annular ring 67 attached to the plunger shaft 31 and engaging rotating in a corresponding ring groove in the mouth piece cap 33. It also represents an irreversible plug-in connection for both parts.

The components of the discharge valve V1, which is a deformable rubber piece, at least in part, are a valve disk 69 and a stem 70 coaxially attached thereto and changing to a stopper part 71. The design is rotation symmetrical while the stopper part 71, which is basically cylindrical, is flattened in two places over the entire length. The flattened parts are designated with 72. They represent longitudinal channels 73 opposite to the cylindrical interior wall of the mouth piece cap 33 which encompasses the casing of the stopper part 71. The longitudinal channels 73 have the cross section of the segments of a circle. Said flattened parts 72 are diametrically opposed and are vertically oriented in FIG. 5.

Running angled in the direction of flow, the flattened parts 72 or the resulting longitudinal channels 73, respectively, join the supply channels 66 located on the front side of the stopper part 71. The supply channels 66 are tangent and run into a circular swirl chamber 74. The tangent inflow is also diametrically opposed. The supply channels 66 appearing in the form of troughs on the front surface in FIG. 7 are covered by the interior surface of the bottom of the mouth piece cap 33.

The swirl chamber 74 is eccentric with respect to the rotational axis x-x of the mouth piece cap 33. The same applies to the mouth piece opening 9 which forms the spray nozzle of the spray pump 3. The mouth piece opening 9 is relocated in that the mouth piece cap 33 is rotated such that the mouth piece opening 9 leaves the supply area of the swirl chamber 74 and thus is sealed and located in front of a part of the discharge valve's V1 front surface which does not contain any channels and which has a locking effect.

The valve function of the valve disk 69 is such that, in the direction of flow, the upper part as seen in the drawing, is pushed over in the manner of a valve flap (see dash-dot representation in FIG. 6). The connecting channel 32 provides a stable support shoulder 76, oriented vertically to the axis x-x, in that it creates a valve storage space 75 which has a clearly larger diameter than the virtually segment-shaped connecting channel 32. The discharge valve V1 is simply inserted through the open end of the valve storage space 75. The mouth piece cap 33 is then clipped on to provide a cover.

The stem 70 on the discharge valve V1 is axially oriented and is positioned in the range of the support shoulder 76.

As to the other type of bearing in the area of the joint II, a vertically oriented lock is provided between the buckling bridge (sections a, b) and the housing 4. The locking connection on the housing side of the second buckling bridge section b is achieved by means of a hook 77 which is attached to the above mentioned bridge section b. The actual hook has reference No. 78. The hook 78 passes through a hole 79 which is provided in a housing console 80. The latter is attached freely projecting to the end of the housing 4 opposite to the mouth piece opening 9. The anchoring hold is clearly illustrated in FIGS. 5 and 6. These also show that the hook 77 is adjacent to an outer supporting web 81 whose end surface, which is directed toward the upper side of the housing console 80, creates the joint II in that it is thrust against the console 80. The respective contact point is close to but behind the hole 79, i.e. offset in outward direction.

The supporting web 81 runs substantially parallel to the shaft of the hook 77. The shaft even has a certain spring function (leaf spring) and may be somewhat lengthened, which is demonstrated by FIG. 6.

The supporting web 81 is a component of the end of the respective buckling bridge section b.

All disclosed characteristics represent an essential part of the invention. The disclosure of the application also includes the complete disclosed content of the pertaining/attached priority documents (copy of the pre-application), which also serves the purpose of incorporating characteristics of these documents in the claims of this application.

What is claimed is:

1. Hand lever-operated spray pump (3) having a housing with an upper side and a rear end and a hand lever, the pump being particularly for attaching to a bottle (2) or similar, having a pump plunger (6) that shifts linear in a pump chamber 7 on the housing, the pump plunger (6) being connected with the hand lever (5) at the rear of a mouth piece opening 9 and the pump plunger (6) returning to its starting position as a result of a spring loading, characterized in that a first and a second joint I, II are associated with hand lever (5), the first joint I being movable in a linear guide on the housing, and the second joint II being attached to the housing at the rear end thereof in such a way that both joints I, II are connected via two buckling bridge sections, comprising a first bridge section (a) and a second bridge section (b).

2. Hand lever-operated spray pump pursuant to claim 1 wherein the second bridge section (b) supports a closing member (19) of a ventilation aperture (20) which leaves its sealing position with respect to the ventilation aperture (20) in the buckling process.

3. Hand lever-operated spray pump as claimed in claim 1 wherein the bridge sections (a, b) rest on the housing (4) in starting position (FIG. 3).

4. Hand lever-operated spray pump as claimed in claim 1 wherein a living hinge (15) is provided between the two bridge sections (a, b).

5. Hand lever-operated spray pump as claimed in claim 1 wherein the second bridge section (b) has a U-profiled connector part (25) which encompasses the housing in a U-shape.

6. Hand lever-operated spray pump as claimed in claim 5 wherein by a locking connection (26, 27) of the U-profiled part (25) toward the housing (4).

7. Hand lever-operated spray pump as claimed in claim 1 wherein the second joint (II), located on the side opposite to the mouth piece opening (9), is a living hinge adjacent to the location of the locking connection (26/27).

8. Hand lever-operated spray pump as claimed in claim 1 wherein the pump plunger (6) has a front end (36) and tapers approximately to its front end, that it is seated there in form-fit connection with a mouth piece cap 33 and that between the front end and the cap (36, 33) a discharge valve (VI) is positioned which is a deformable rubber piece.

9. Hand lever-operated spray pump as claimed in claim 8 wherein the rubber piece, having a collar (37) that expands as a result of the pressure caused by the fluid, is positioned at the front end (36) of the pump plunger (6) and that it has axial flow-through cross sections (39) in a disk-shaped base part (38) which are connected with an opening (9) in the mouth piece cap (33) to permit the flow when the mouth piece cap (33) is rotated in a position of permitting flow.

10. Hand lever-operated spray pump as claimed in claim 1 wherein the housing (4) is attachable to the neck (1) of a bottle (2) by means of a plug-in/clip connection.

11. Hand lever-operated spray pump as claimed in claim 1 wherein by a disk-shaped inlet valve (V2) having a valve closing member (44) supported by webs (45), which disk supports the pump plunger restoring spring (8) whose opposite end moves against a cross section reducing shoulder (30) in the interior of the hollow pump plunger (6), which pump plunger (6) trails on the wall of the pump chamber (7) with the edge (48) of the larger cross section opening.

12. Hand lever-operated spray pump as claimed in claim 1 wherein the hand lever (5) is formed with trunnions (11) and pump plunger 6 is equipped with lateral pockets (13) for the trunions (11) of the hand lever (5).

13. Hand lever-operated spray pump as claimed in claim 1 wherein the pump chamber is defined by a housing wall (60) and the housing wall (60) is provided with a ventilation aperture (61) extending into the interior (22) of the bottle (2), which, in pump starting position, is closed by the pump plunger (6) and is opened when the pump plunger (6) is activated.

14. Hand lever-operated spray pump as claimed in claim 13 wherein the pump plunger (6) is equipped with two piston rings (63, 64), which, in pump plunger starting position, are located on either side of the mouth (62) of the ventilation aperture (61).

15. Hand lever-operated spray pump as claimed in claim 1 wherein a disk-shaped inlet valve body comprises a rim, a central closing hub and zigzag spokes connecting the central hub and rim.

16. Hand lever-operated spray pump as claimed in claim 15 wherein the valve closing member (44) of the inlet valve (V2) is barrel-shaped having hemispherical ends on both sides.

17. Hand lever-operated spray pump as claimed in claim 1 wherein by a discharge valve (V1) covered by the mouth piece cap (33) and having supply channels (66) on the forepart leading to the mouth piece opening (9), which supply channels (66) can be closed when the mouth piece cap (33) is rotated.

18. Hand lever-operated spray pump as claimed claim 17 wherein the discharge valve (V1) is a deformable rubber piece equipped with a stem (70) and that the stem (70) supports a valve disk (69) on one end, and is equipped at the other end with a cylindrical stopper part (71) with channel-forming, diametrically opposed flattened parts (72) from which supply channels (66) begin on the forepart and lead to a central swirl chamber (74).

19. Hand lever-operated spray pump as claimed in claim 18 wherein the swirl chamber (74) is arranged eccentric.

20. Hand lever-operated spray pump as claimed in claim 1 wherein the locking connection on the housing of the second buckling bridge section (b) is achieved by means of a hook (77) which is adjacent to a supporting web (81) whose front surface (82) creates the second joint (II) which abuts against a housing console (80) provided at the rear end of the pump.

21. Hand lever-operated spray pump as claimed in claim 20 wherein the hook (77) comprises a shaft which passes through a hole (79) in the rear of the housing console (80), and that a supporting web (81) in end of the second bridge section which is located behind the hole (79) and which creates the second joint II and which extends substantially parallel to the shaft of the hook 77.

22. A pump dispenser comprising:

a. a housing part having a front end and a rear end and a downward portion for mounting on a container;

b. a pump cylinder fixedly disposed on the housing part and having an open end facing the front end of the housing part and formed with slots along opposite sides of the open end;

c. a piston/nozzle assembly reciprocable in the open end of the cylinder;

d. a trigger/cover assembly comprising a cover portion having a forward and a rearward end, the rearward end being hingedly connected to the rear end of the housing part and a trigger portion having an upper end, an intermediate portion and a lower end, the upper end being hingedly connected to the forward end of the cover portion, the intermediate portion being pivotally connected to the piston/nozzle assembly through the slots, the lower end of the trigger portion serving as a trigger lever.

23. A pump dispenser as claimed in claim 22 wherein the trigger/cover assembly is a molded unit and the hinge connection between the cover portion and the trigger portion is a "living" hinge.

24. A pump dispenser as claimed in claim 22 wherein the housing part is formed with a vent opening and the cover had a downward plug which closes off the vent opening when the trigger is relaxed.

25. A pump dispenser as claimed in claim 22 wherein the hinged connection at the rear end of the housing portion comprises a hook on the cover portion which engages in an opening in the housing portion.

26. A pump dispenser as claimed in claim 22 wherein the trigger/cover assembly includes sidewall portions covering parts of the housing part.

27. A pump dispenser as claimed in claim 22 wherein the trigger portion is inverted L-shape having a rearwardly directed shorter leg and a downward longer leg, the distal end of the shorter leg being hingedly connected to the front end of the cover portion.

28. A pump dispenser as claimed in claim 27 wherein the hinged connection is a "living" hinge.

29. A pump dispenser as claimed in claim 28 wherein the top surfaces of the shorter leg and the cover portion define a substantially straight line when the trigger is released.

30. A pump dispenser as claimed in claim 22 wherein the trigger portion is bifurcated to either side of the cylinder and the connection between the trigger portion and the piston/nozzle assembly is achieved by inward trunions on the bifurcations, the trunions sliding in the slots and engaging pockets on the piston/nozzle assembly.

31. A pump dispenser comprising:

a. a housing part having a front end and a rear end and a downward portion for mounting on a container;

b. a pump cylinder fixedly disposed on the housing part and having an open end facing the front end of the housing part;

c. a piston/nozzle assembly reciprocable in the open end of the cylinder;

d. a hinge support element extending upward from the housing part and having a hinge element at a forward end above the cylinder, e. a trigger element having its upper end pivoted to the hinge element, an intermediate portion pivotally attached to the piston/nozzle assembly and a lower portion serving as a trigger lever, the improvement wherein the hinge support element is pivoted to the housing part at its rear end, and the cylinder has slots on its opposite sides and the pivotal attachment of the trigger element rides in the slots.

32. A pump dispenser as claimed in claim 31 wherein the hinge support element and the trigger element is one molded unit and the hinge element is a "living" hinge.

33. A pump dispenser as claimed in claim 31 wherein the hinge support element is hingedly attached to the housing part at the rear end of the housing part.

34. A pump dispenser as claimed in claim 31 wherein the attachment of the hinge support element to the housing part is by a hook on the hinge support element hooked into a perforation at the rear end of the housing part.

35. A pump dispenser as claimed in claim 31 wherein the trigger element is bifurcated and the bifurcations straddle the cylinder and are formed with inward trunions which engage in pockets formed in the piston/nozzle assembly to comprise the pivotal attachment of the trigger element to the piston/nozzle assembly.

36. A pump dispenser as claimed in claim 31 wherein the trigger element has in inverted L-shape and the upper end of the trigger element comprises a shorter leg of the trigger element and extends rearward of the pivotal attachment of the trigger element to the piston/nozzle assembly.

37. A pump dispenser as claimed in claim 36 wherein the top surface of the shorter leg of the upper end of the trigger element is in a straight line with the top surface of the hinge support element when the trigger is in its forwardly pivot position.

38. A pump dispenser as claimed in claim 31 wherein the hinge support element serves as a cover for the cylinder.

39. A pump dispenser comprising:

a. a body having a front end and a rear end and a downwardly facing closure for mounting on the finish of a container;

b. a pump cylinder unitary with the body and having an open end facing the front end of the body and formed with slots along opposite sides of the open end;

c. a piston/nozzle assembly reciprocable in the cylinder and having pockets on opposite sides thereof;

d. a unitary molded trigger/cover element covering the cylinder and comprising a cover portion having a forward and a rearward end, the rearward end being connected to the rear end of the housing part, and an inverted L-shaped trigger portion defined by a rearwardly directed shorter leg and a downwardly directed longer leg, the distal end of the shorter leg being connected to the forward end of the cover portion by a living hinge, the downwardly directed longer leg being bifurcated intermediate its ends with the bifurcations straddling the cylinder, the bifurcations having inward trunions extending through the respective slots in the cylinder and into the pockets respectively to pivotally connect at a pivot point the trigger portion to the piston/nozzle assembly through the slots, the pivot point being forward of the living hinge, the lower end of the trigger portion serving as a trigger lever, the top surfaces of the shorter leg and the cover portion defining a substantially straight line when the trigger lever is forward.

40. A pump dispenser as claimed in claim 39 wherein the connection between the rear end of the cover portion and the rear end of the body is a pivotal connection.

41. A pump dispenser as claimed in claim 40 wherein the pivotal connection between the rear end of the cover portion and the rear end of the body comprises a hook on the cover portion engaging a perforation on the body.

42. A pump dispenser comprising:

a. a pump body including a horizontal cylinder having an open end and longitudinal guide slots extending on opposite sides of the cylinder from the open end, b. a piston in the cylinder, c. a trigger assembly pivotally secured to the body at a first point and including a lever and a tension element joined by a living hinge, d. a transverse element on the trigger assembly engaging the piston at a second point on the opposite side of the living hinge from the first point and sliding in the longitudinal guide slots, whereby moving the lever in one direction draws the first and second points toward each other to move the piston as the living hinge flexes.

* * * * *